US006698165B1

(12) United States Patent
Natterer

(10) Patent No.: US 6,698,165 B1
(45) Date of Patent: Mar. 2, 2004

(54) APPARATUS FOR SEPARATING LAMINATED AREAS OF MULTI-LAYERED FILM, PACKAGING MACHINE COMPRISING THIS APPARATUS AND PACKAGE HAVING A COVER FILM CONSISTING OF AT LEAST TWO LAMINATED LAYERS

(75) Inventor: Hans Natterer, Legau (DE)

(73) Assignee: Multivac Sepp Haggenmuller GmbH & Co., Wolfertschwenden (DE)

( * ) Notice: Subject to any disclaimer, the term of this patent is extended or adjusted under 35 U.S.C. 154(b) by 0 days.

(21) Appl. No.: 09/540,647

(22) Filed: Mar. 31, 2000

(51) Int. Cl.[7] ..... B65B 61/18; B65B 11/52

(52) U.S. Cl. ..... 53/509; 53/517; 53/441; 53/449; 53/412; 53/427; 53/282; 426/392; 426/396

(58) Field of Search ..... 53/517, 441, 449, 53/412, 427, 509, 282; 426/392, 396

(56) References Cited

U.S. PATENT DOCUMENTS

| | | | | |
|---|---|---|---|---|
| 3,713,849 A | | 1/1973 | Grinrod et al. | 99/174 |
| 4,671,043 A | * | 6/1987 | Forni et al. | 53/441 |
| 5,402,622 A | | 4/1995 | Stockley, III et al. | 53/427 |
| 5,591,468 A | | 1/1997 | Stockley, III et al. | 426/106 |
| 5,632,134 A | * | 5/1997 | Noel et al. | 53/433 |
| 5,766,280 A | * | 6/1998 | Hallqvist et al. | 53/441 |
| 5,779,050 A | | 7/1998 | Kocher et al. | 206/497 |
| 6,044,622 A | | 4/2000 | Brady et al. | 53/412 |

FOREIGN PATENT DOCUMENTS

| | | | |
|---|---|---|---|
| EP | 0 721 899 A1 | 7/1996 | |
| EP | 1 020 366 A1 | 7/2000 | B65B/61/18 |

* cited by examiner

*Primary Examiner*—Rinaldi I. Rada
*Assistant Examiner*—Brian Nash
(74) *Attorney, Agent, or Firm*—George W. Neuner; Edwards & Angell LLP

(57) ABSTRACT

A packaging machine is described. A plurality of working stations is arranged between the input side and output side of the machine. A conveyor moves packages carrying a product along a path from the input side to the output side through the working stations. A device feeds a cover film onto the packages. The cover film has two layers bonded together with a limited bonding strength. A first layer has a portion protruding beyond said second layer. Another device separates the first layer from the second layer in a defined region extending across the cover film transversely to the conveyor path. The separator seals the defined region of the cover film and supplies a pressurized fluid to said defined region. The defined region includes at least part of the protruding portion of the first layer. A method of using the packaging machine to package product also is described along with the package that is made.

7 Claims, 6 Drawing Sheets

APPARATUS FOR SEPARATING LAMINATED AREAS OF MULTI-LAYERED FILM, PACKAGING MACHINE COMPRISING THIS APPARATUS AND PACKAGE HAVING A COVER FILM CONSISTING OF AT LEAST TWO LAMINATED LAYERS

BACKGROUND OF THE INVENTION

The invention relates to an apparatus and a method for separating the layers of a multi-layered film having at least two laminated layers, a packaging machine comprising this apparatus and a package comprising a cover film consisting of at least two laminated layers.

In the field of meat packaging the problem arises that fresh meat in contact with the oxygen of the air exhibits a red color, but changes to a brown or violet color under exclusion of oxygen, thereby having an unappetizing appearance. The conventional skin packages have the meat lying in a tray and covered by an upper or cover film which is sealed to the edge of the tray and coats the meat like a skin. In case that this cover film consists of an oxygen impermeable film, some time after the packaging process the above-mentioned color change of the meat to a brown or violet color will take place. When using an oxygen permeable film for the cover film, the meat will retain the red color or take it on again.

In order to solve this problem, U.S. Pat. No. 5,591,468 proposes to use two overlying separate layers as cover film, the lower layer being oxygen-permeable and the upper layer being oxygen-impermeable. The two layers are sealed to the edge of the package at respective two separate sealing seams. The upper layer can be pulled off immediately before offering the packages for sale, whereby the meat takes on a red color and a hermetic seal of the package up to this point in time is ensured, thereby keeping the quality of the meat. However, the known method and package disadvantageously require the use of two separate film rolls for producing the package and the generation of two separate sealing seams. This renders the entire method complicated and the corresponding apparatus expensive.

European patent application EP 0 721 899 A1 discloses the use, for skin packages, of a cover film consisting of laminated layers. With this known skin package, however, the problem arises that it is difficult to separate the laminated layers from each other and a separate apparatus is required for providing a point of impact for separating the upper layer from the lower layer.

OBJECTS OF THE INVENTION

It is an object of the invention to provide an improved apparatus and method for separating the layers of a multi-layered film. It is a further object of the invention to provide an improved packaging machine using such a multi-layered film and a package comprising such a multi-layered film. Specifically, it is an object of the invention to provide a package which ensures that the product therein, in particular meat, is kept fresh and which allows, at a desired moment, oxygen to come into contact with the product in an easy manner. It is a still further object of the invention to provide an apparatus for separating a film consisting of at least two laminated layers, and a corresponding method, providing an easy way of separating one layer from the other, whereby this film can be used as cover film in packages. Finally, it is an object of the invention to provide a packaging machine for producing the above-mentioned packages.

SUMMARY OF THE INVENTION

In order to achieve the above-mentioned objects, the invention provides an apparatus for separating the layers of a multi-layered film in at least an edge region thereof, the film having a first layer and a second layer bonded to the first layer with a limited bonding strength, the first layer having a portion which projects beyond the second layer, the apparatus comprising means for sealing a defined region of the film from the remaining region thereof, the defined region representing the edge region for separating the layers and including at least part of the projecting portion of the first layer, and means for feeding a pressurized fluid to the defined region.

According to a further aspect the invention provides a method of separating the layers of a multi-layered film in an edge region thereof, the film having a first layer and a second layer bonded to the first layer with a limited bonding strength, the method comprising the steps of clamping the film along a border of the edge region and passing a pressurized fluid through the edge region.

According to a third aspect the invention provides a packaging machine comprising an input side, an output side, a plurality of working stations arranged between the input side and the output side, conveyor means for conveying packages along a conveyor path from the:input side to the output side through the working stations, the packages having product carrying means with a product thereon, means for feeding a cover film onto the packages, the cover film having a first layer and a second layer bonded to the first layer with a limited bonding strength, the first layer having a portion which projects beyond the second layer, and means for separating the first layer from the second layer in a defined region extending across the cover film transversely to the conveyor path.

According to a fourth aspect the invention provides a package comprising a product receiving member having an edge, a product on the product receiving member, and a cover film covering said product and sealed to the edge so as to enclose the product between the product receiving member and the cover film, the cover film being a laminated film having at least two layers bonded to each other with a limited bonding strength and separated from each other at a region adjacent to a lateral edge of the cover film, the cover film projecting beyond the edge of the product receiving member at the separated region.

BRIEF DESCRIPTION OF THE DRAWINGS

Further advantages, features and objects of the invention will be apparent from the description of embodiments with reference to the drawings. In the drawings.

DESCRIPTION OF THE PREFERRED EMBODIMENTS

Figure 1:
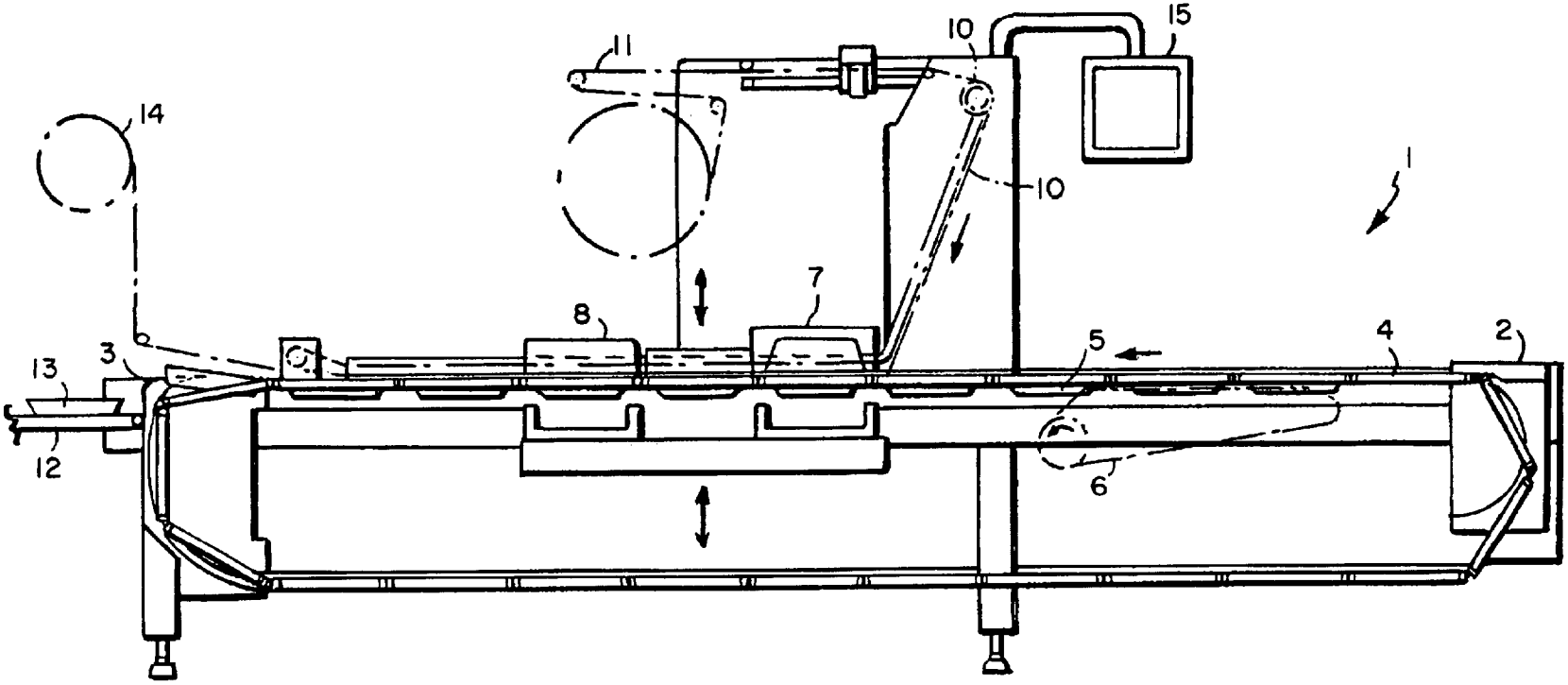
FIG. 1 is a side view of a packaging machine.

As shown in FIG. 1 a packaging machine 1, specifically a tray sealing machine, comprises a machine frame having an input side 2 and an output side 3. A plurality of tray carriers 4 adapted to receive trays 5 are conveyed along the frame from the input side to the output side through working stations arranged successively in conveyor direction. A conveyor device 6 formed as a conveyor chain is provided for conveying the continuous series of tray carriers 4. The working stations include a closing or sealing station 7 for sealing an upper film or cover film 11 to the peripheral flange or edge of the trays for sealing the package and a cutting station 8 for cutting the cover film. A separating station 9 for separating the laminated layers of the cover film is arranged at the supply region of the cover film 11. Furthermore, there is provided a transporting device 10 for feeding and transporting the cover film 11.

The packaging machine further includes a conveyor belt 12 for taking away the finished packages 13 after their passage through the working stations. Moreover, a roll 14 serves for winding up the remainders of the cover film 11 after the cutting operation.

A control device 15 controls the operation of the packaging machine in a coordinated manner.

As shown in the FIGS. 2 to 9 the cover film 11 is a laminated film having at least two laminated layers, a first layer 20 which is substantially oxygen impermeable and a second layer 21 which is bonded to the first layer and substantially oxygen-permeable. The first layer and the second layer 21 are bonded to each other with a limited bonding or adhesive strength therebetween which means that the layers can be separated from each other without damaging the same. As shown in particular in the FIGS. 2 to 5 the web of the oxygen-impermeable first layer 20 is wider than that of the oxygen-permeable second layer 21 by an amount s and projects on one side beyond the second layer 21 by the amount s in a border region 22 of the web. The oxygen-impermeable first layer is stronger than the oxygen-permeable layer. Since the oxygen-impermeable layer projects beyond the oxygen-permeable layer and forms the stronger one of both layers, the oxygen-impermeable layer can be firmly gripped without risk of damage at the edges of the film for transport thereof.

Figure 2:
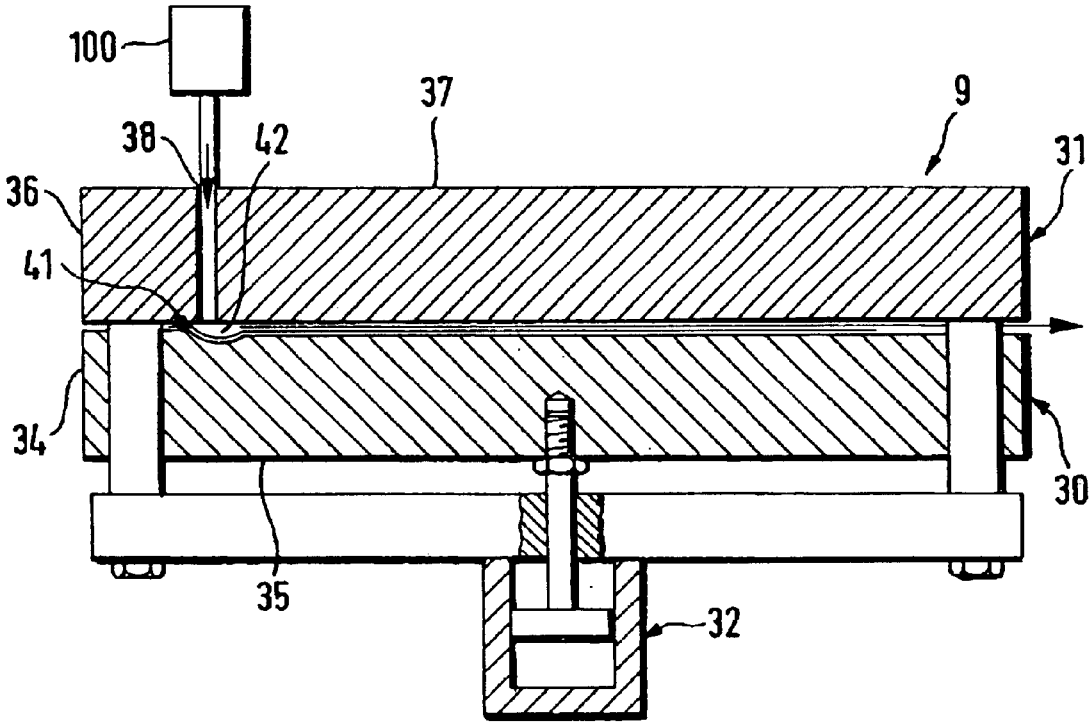
FIG. 2 shows a section of an apparatus for separating two laminated layers of a packaging film, seen in conveying direction.

As particularly shown in FIG. 2 the inventive separating station 9 for the cover film 11 comprises a first tool member being a lower tool member 30 and extending across the entire width of the cover film 11 transversely to the conveyor direction, and a second tool member, being an upper tool member 31 and in working cooperation with the lower tool member 30. The lower tool 30 can be lifted and lowered relative to the upper tool member 31 by means of a lifting device formed as a piston-cylinder-device 32, as shown in FIG. 2. The lower tool member 30 and the upper tool member 31 are both formed as bars or beams having respective short sides 34, 36 extending parallel to the conveyor direction and long sides 35, 37 extending perpendicular or transverse to the conveyor direction. As shown in the FIGS. 2 to 4, the lower tool member 30 comprises a hollow or trough-shaped recess 33 spaced from the short side 34. At a position opposite to the recess 33, in a cooperating state of both tool members, the upper tool member 31 comprises means for feeding compressed air in the form of two bores 38, 39 extending vertically through the entire upper tool member 31. The upper end of the bores facing away from the lower tool member 30 is connected with a compressed-air source 100.

Figure 3:
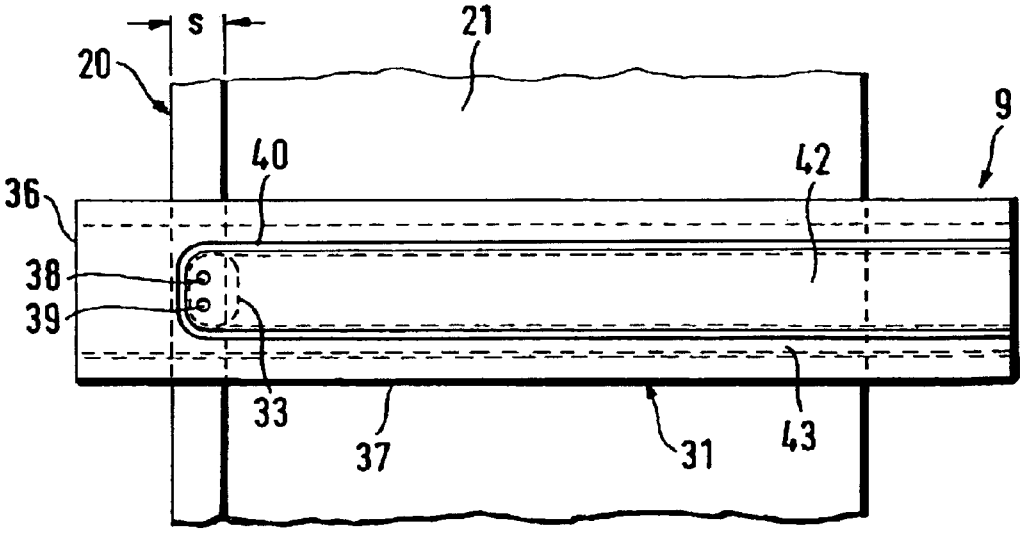
FIG. 3 is a top view of the apparatus of FIG. 1, showing boundary lines of the separating region.
Figure 4:
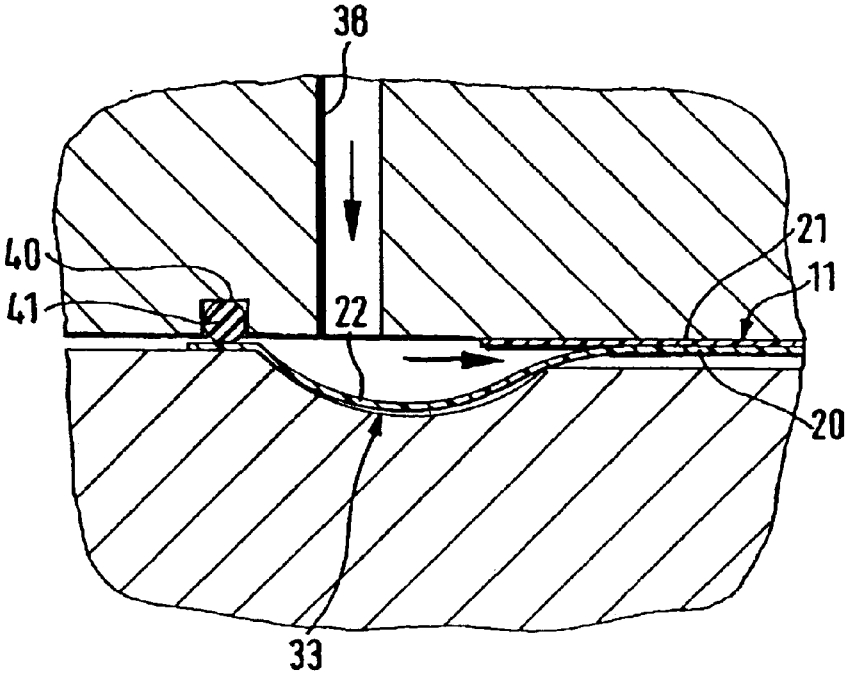
FIG. 4 showing a portion of FIG. 2 in an enlarged representation.

As shown in the FIGS. 2 to 4 the upper tool member 31 further comprises, at its lower side facing the lower tool member 30, a channel or groove 40 extending, in the first embodiment shown in FIG. 3, substantially parallel to the long side 37 and substantially parallel to one of the short sides 36 and spaced therefrom. An O-ring gasket or toroidal sealing ring 41 is located within the groove 40 for sealing purposes. The groove 40 is not a closed loop; rather, it is open at the other short side of the upper tool member. The gasket 41 in the groove 40 defines, in cooperating state of the tool members, a region 42 between both tool members within the loop formed by the groove which is sealed off from the region 43 between both tool members outside of the groove. The groove 40 is further arranged so as to include, in a cooperating state of both tool members, the recess 33 at the lower tool member 30 in the sealed region 42.In the embodiment shown in FIG. 3 the sealed region 42 formed in cooperating state of the tool members 30, 31 is formed as a straight strip extending across the film web. The fact that the groove 40 is open at one end enables air to flow through the sealed region 42 from the ends of the bores 38, 39 facing the compressed-air source to the side of the upper tool member having the open ends of the groove 40.

The separating station 9 is disposed in, the packaging machine in such a manner that, in cooperating state of the tool members, the projecting region 22 of the first layer 20 of the cover film 11 overlaps the trough-shaped recess. The diameter of the trough-shaped recess 33 is slightly greater than the projecting amount s of the first layer 20 beyond the second layer 21, whereby the second layer 21 projects into the trough-shaped recess 33 to some extent in cooperating state of the tool members.

In operation of the packaging machine the transporting device 10 firmly grips the cover film 11 on both sides of the film web and passes it through the working stations closely above the trays 5. In cases in which the product is within the trays, the trays are sealed in the sealing station 7 in conventional manner. However, the same machine is also suitable to seal packages wherein the product projects beyond the upper edge of the trays, since the cover film is held in stretched condition and urges the product into the tray, whereafter the sealing operation is carried out. The cover film 11 connecting the individual packages is cut in the cutting station 8. The remainders of the cover film are wound up onto the roll 14.

The separating station 9 is operated in every working cycle of the packaging machine. The lifting device 32 moves the lower tool member 30 towards the upper tool member 31 and effects a predetermined contact pressure of the lower tool member 30 against the upper tool member 31, whereby the cover film 11 is clamped between the lower tool member 30 and the upper tool member 31. As a result of the positioning of the separating station 9 relative to the film web of the cover film 11 the region 22 of the first layer 20 projecting beyond the second layer 21 is placed above the recess 33 and the gasket 41 is inside of the outer edge of the projecting region 22 of the first layer 20.

In this working cycle pressurized air is subsequently fed into the sealed region 42 through the compressed-air bores 38, 39 in the upper tool member 31. The pressurized air generates a force acting onto the projecting region 22 of the first layer so as to urge this projecting region into the recess 33. The resulting stress between the first layer 20 and the second layer 21 causes a detachment or separation of the second layer from the first layer first in the region of the recess 33. Since the sealed region 42 is open at one side of the tool members, the pressurized air may enter or penetrate between the layers, and the separation of the second layer 21 from the first layer 20 continues, starting from the recess 33, across the entire width of the cover film 11 so as to form, in the cover film, a separated region of both laminated layers 20 and 21, the separated region forming a straight strip extending transversely across the film web.

Figure 6:
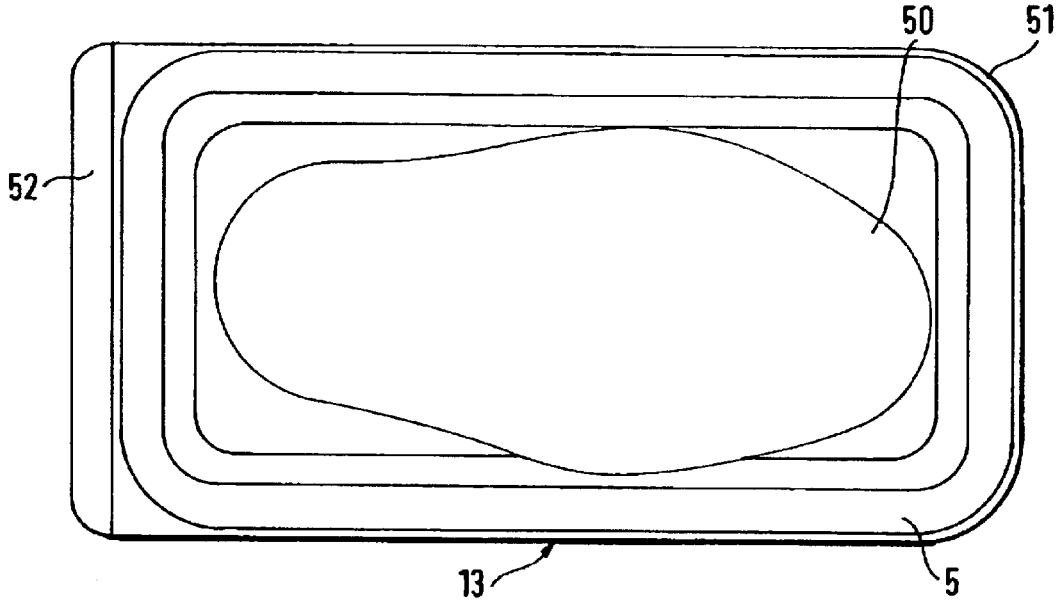
FIG. 6 is a top view of a package having the two laminated layers of the cover film separated at one side of the package.
Figure 7:
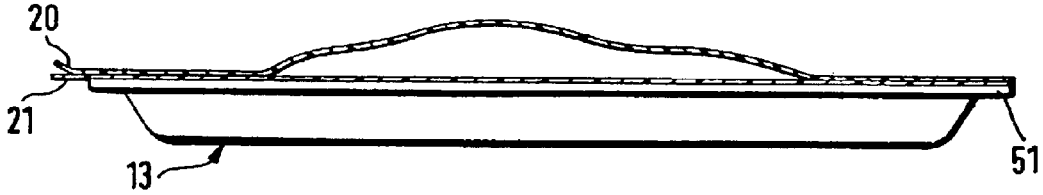
FIG. 7 is a side view of the package of FIG. 6.
Figure 8:
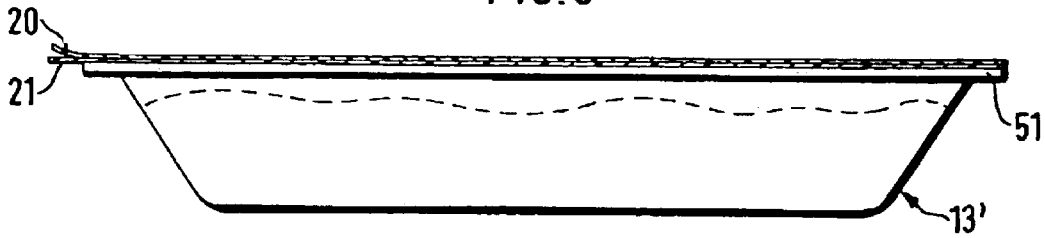
FIG. 8 is a side view of a package according to FIG. 6 with inert protective gas.

After passing the cutting station the finished package 13 is formed as shown in FIG. 6. The tray 5 contains a product 50 and is sealed with the cover film in the region of the peripheral rim or edge 51 of the tray. The packages are severed in the cutting station 8 in such a manner that the separated region of the laminated layers 20, 21 of the cover film 11 forms a tab 52 projecting beyond the rim 51 of the tray 5. Since the tray carriers are adapted to carry the trays 5 having their narrow side extending transversely to the conveyor direction, the tab region 52 is formed at the narrow side of the package 13. FIG. 7 shows an example of a package 13 wherein the product projects above the upper side 51 of the tray, and FIG. 8 shows an example of a package 13' having the product within the tray and being entirely below the upper rim 51 of the tray, for example, in the case of a package with protective inert gas. The cover film is arranged so that the oxygen-permeable layer 21 is at the side of the cover film facing the product and the oxygen-impermeable layer 20 is on the opposite side of the cover film facing away from the product.

Before displaying the packages for sale the first layer 20 of the cover film, i.e., the upper layer, is grasped in that region where it is separated from the lower layer 21, and pulled off from the layer 21.

Figure 5:
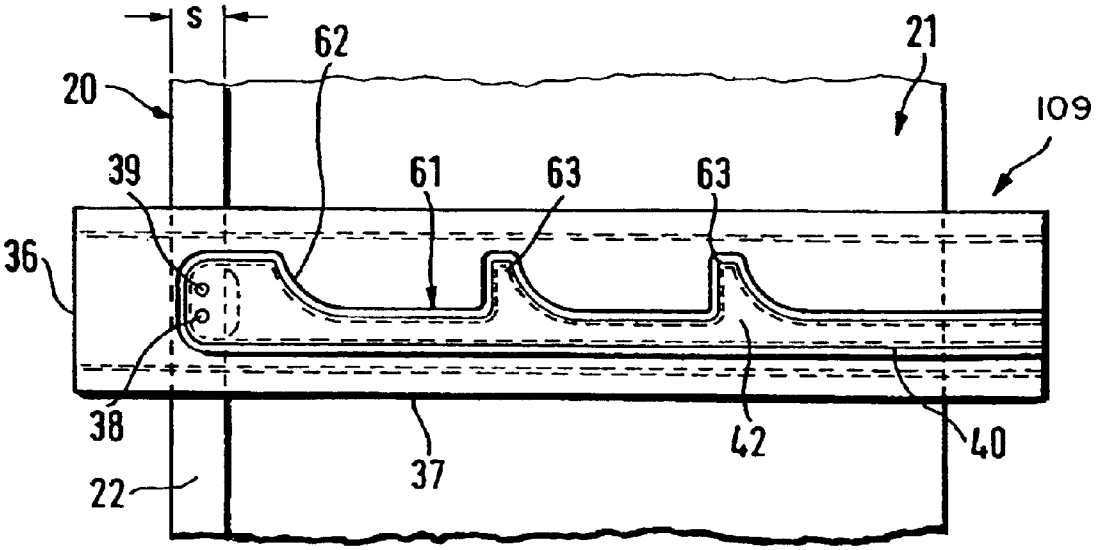
FIG. 5 is a top view of a further embodiment of an apparatus for separating two laminated layers.
Figure 9:
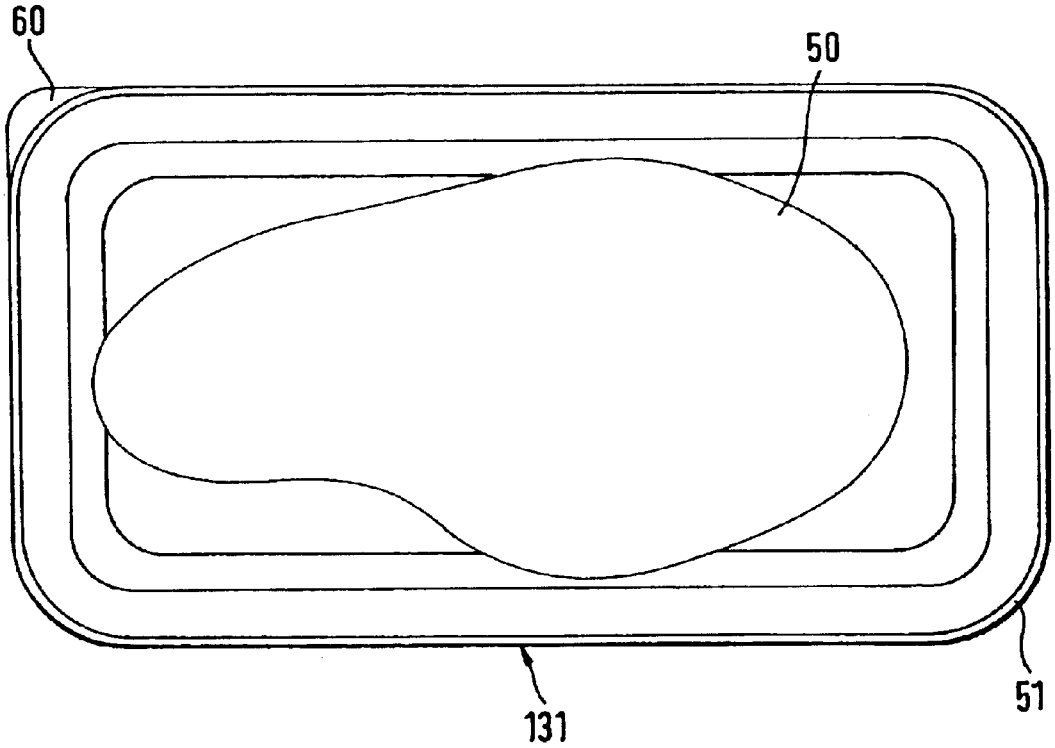
FIG. 9 is a top view of a package having the laminated layers of the cover film separated at one corner of the package.
Figure 10:
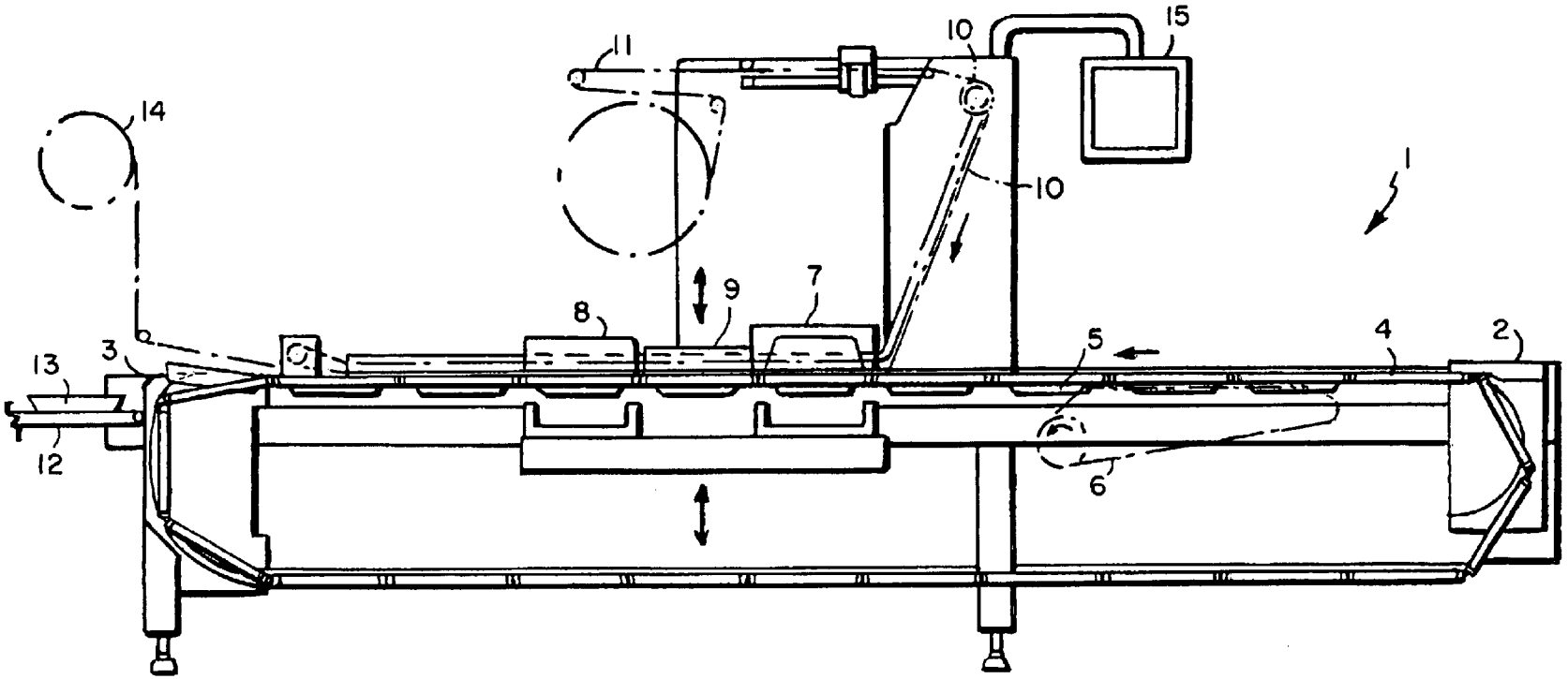
FIG. 10 is a side view of a packaging machine illustrating an alternative location for a station.

In the further embodiment of a separating station 109 shown in FIG. 5 the groove 40 with the gasket 41 therein is specifically shaped for producing the region 60 defining the package 131 shown in FIG. 9, the region 60 defining the separation of the laminated layer 20, 21 being produced, in this case, at a corner of a package. To this end the groove 40 runs along a long side of the upper tool member 31 so as to form a number of indentations or bays 61 corresponding to the number of packages arranged side by side and having a contour of a lying divided U, whereby the rounded base 62 of the U corresponds to the curvature of one corner of the tray edge. The bays 61 of the groove 40 define corner regions 63 of the sealed region 42 so that, after cutting the cover film in the cutting station, the region 60 of the cover film shown in FIG. 9 and defining the separated region of the laminated layers is formed at one corner of the package.

In a further embodiment shown schematically in FIG. 1 a separating station 9' for separating the laminated layers of the cover film, as described above, is arranged behind the sealing station 7 rather than before the sealing station as in the case of the separation station 9. The position behind the sealing station is advantageous in that the positions of the separated regions need not be taken into account in the sealing station, because these regions are produced after the sealing operation.

While the invention has been described in preferred form, it is not limited to the precise nature shown as various modifications may be made without departing from the scope and spirit of the appended claims.

What is claimed is:

1. A method for producing a package having a tray with a peripheral rim, a product on said tray and a cover film covering said product and sealed to said rim so as to enclose said product between said tray and said cover film, said cover film being a laminated film having at least two layers bonded to each other with a limited bonding strength and separated from each other at a defined region adjacent a lateral edge of said cover film, said cover film projecting beyond said edge of said tray in said separated region, said method comprising the steps of:

providing a packaging machine comprising:

an input side, an output side, a plurality of working stations arranged between said input side and said output side, conveyor means for conveying packages along a conveyor path from said input side to said output side through said working stations, said packages having a product carrying means with a product thereon, means for feeding a cover film onto said packages, said cover film having a first layer and a second layer bonded to said first layer with a limited bonding strength, said first layer having a portion protruding beyond said second layer in a direction transverse to said conveyor path on at least on one lateral edge of said cover film, and means for separating said first layer from said second layer in a defined region extending across said cover film transversely to said conveyor path said defined region including at least part of said protruding portion of said first layer, wherein said means for separating comprises means for feeding a pressurized fluid to said defined region and means for sealing said defined region of said cover film from the remaining regions thereof on at least two sides transverse to said conveyor path and on a side along the conveyor path, such that a region around a portion of the lateral edge of the second layer including at least part of said protruding portion of said first layer is sealed where the pressurized fluid is introduced;

arranging a series of successive trays on the conveyor means to be filled, filling said product into said trays, gripping a web of said cover film, closing said filled trays using said cover film by sealing said cover film to said rim of said trays, cutting said cover film between successive trays for forming individual packages, and separating said layers of said cover film in said defined region with the means for separation by clamping said cover film along a border of said defined region and passing the pressurized fluid through said defined region.

2. The method of claim 1, comprising separating said layers of said cover film before sealing said cover film to said trays.

3. The method of claim 1, comprising separating said layers of said cover film after sealing said cover film to said trays.

4. A packaging machine comprising:

an input side, an output side, a plurality of working stations arranged between said input side and said output side, conveyor means for conveying packages along a conveyor path from said input side to said output side through said working stations, said packages having a product carrying means with a product thereon, means for feeding a cover film onto said packages, said cover film having a first layer and a second layer bonded to said first layer with a limited bonding strength, said first layer having a portion protruding beyond said second layer in a direction transverse to said conveyor path on at least on one lateral edge of said cover film, and means for separating said first layer from said second layer in a defined region extending across said cover film transversely to said conveyor path, said defined region including at least part of said protruding portion of said first layer, wherein said means for separating comprises means for feeding a pressurized fluid to said defined region and means for sealing said defined region of said cover film from the remaining regions thereof on at least two sides transverse to said conveyor path and on a side along the conveyor path, such that a region around a portion of the lateral edge of the second layer including at least part of said protruding portion of said first layer is sealed where the pressurized fluid is introduced.

5. The packaging machine of claim 4, wherein one of said working stations is a sealing station and said means for separating said first layer from said second layer is located ahead of said sealing station in said conveyor path.

6. The packaging machine of claim 4, wherein one of said working stations is a sealing station and said means for separating said first layer from said second layer is located behind said sealing station in said conveyor path.

7. The packaging machine of claim 4, wherein said packages are trays sealed by said cover film and said packaging machine is a tray sealing machine.

* * * * *

UNITED STATES PATENT AND TRADEMARK OFFICE

CERTIFICATE OF CORRECTION

PATENT NO. : 6,698,165 B1
DATED : March 2, 2004
INVENTOR(S) : Natterer

It is certified that error appears in the above-identified patent and that said Letters Patent is hereby corrected as shown below:

Title page,
Please add the following Item:

-- [30] Foreign Application Priority Data

April 1, 1999 (DE) 199 15 040.0 --

Signed and Sealed this

Seventeenth Day of August, 2004

JON W. DUDAS
*Acting Director of the United States Patent and Trademark Office*